US005642791A

United States Patent [19]

Zerlin et al.

[11] Patent Number: 5,642,791

[45] Date of Patent: Jul. 1, 1997

[54] PLASTIC BAG PACKING SYSTEM

[76] Inventors: Elizabeth Zerlin; Richard Ackerman, both of 48 Acorn Pond Dr., Roslyn, N.Y. 11576

[21] Appl. No.: 593,065

[22] Filed: Jan. 29, 1996

[51] Int. Cl.[6] ..... A47F 9/04; B65B 67/12

[52] U.S. Cl. ..... 186/66; 53/384.1; 248/99

[58] Field of Search ..... 186/66; 248/97, 248/99, 100, 101; 53/492, 384.1; 206/554

[56] References Cited

U.S. PATENT DOCUMENTS

| | | | |
|---|---|---|---|
| 2,899,161 | 8/1959 | Bayard | 248/101 |
| 3,025,651 | 3/1962 | Stanley | 186/66 X |
| 3,646,723 | 3/1972 | Meroney | 53/390 |
| 4,821,985 | 4/1989 | DeMatteis et al. | 248/97 |
| 5,125,604 | 6/1992 | Vrooman et al. | 248/97 |
| 5,183,158 | 2/1993 | Boyd et al. | 206/554 |
| 5,287,971 | 2/1994 | Dorman | 211/12 |
| 5,303,889 | 4/1994 | Malik et al. | 248/97 |

*Primary Examiner*—F. J. Bartuska

[57] ABSTRACT

A plastic bag packing system adapted for use in association with a retail store check out counter having a front wall with a recess extending therein, the recess having a rear wall including a centrally positioned horizontal rod, the apparatus comprising: an electrically powered motor including a rotation device, a pinion gear being operatively coupled to the rotation device, a plurality of wires electrically coupling the motor to an electrical source and an activation device, a rack formed having a plurality of grooves and including a forward end and a rearward end, the rearward end being coupled to the pinion gear such that rotation of the pinion gear causes the rack to move rearward or forward upon engagement of the motor; and a retractable arm assembly comprising two forwardly extending horizontal arms and a horizontal rear bar, the rear bar being coupled to the forward end of the rack, the arms being slidably positioned through the rear wall of the recess, the forward end of each arm including an upturned knob and an upwardly angled rubber heel.

4 Claims, 3 Drawing Sheets

PLASTIC BAG PACKING SYSTEM

BACKGROUND OF THE INVENTION

1. Field of the Invention

The present invention relates to a plastic bag packing system and more particularly pertains to suspending plastic bags in an open orientation by activating the foot pedal of the apparatus.

2. Description of the Prior Art

The use of plastic bag holders is known in the prior art. More specifically, plastic bag holders heretofore devised and utilized for the purpose of holding plastic bags in an open orientation are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,303,889 to Malik a wire holder for plastic bags.

U.S. Pat. No. 5,183,158 to Boyd discloses a bag dispensing system and bag pack.

U.S. Pat. No. 5,125,604 to Vrooman discloses a system for automatic consecutive opening and dispensing thermoplastic grocery or retail product bags.

U.S. Pat. No. 5,287,971 to Dorman discloses a rack for supporting a loaded plastic grocery bags.

U.S. Pat. No. 3,646,723 to Meroney discloses a system for filling a flexible sealable container.

Lastly, U.S. Pat. No. 4,821,985 to DeMatteis discloses a rack for plastic T-shirt grocery bags.

In this respect, the plastic bag packing system according to the present invention substantially departs from the conventional concepts and designs of the prior art, and in doing so provides an apparatus primarily developed for the purpose of suspending plastic bags in an open orientation by activating the foot pedal of the apparatus.

Therefore, it can be appreciated that there exists a continuing need for a new and improved plastic bag packing system which can be used for suspending plastic bags in an open orientation by activating the foot pedal of the apparatus. In this regard, the present invention substantially fulfills this need.

SUMMARY OF THE INVENTION

In view of the foregoing disadvantages inherent in the known types of plastic bag holders now present in the prior art, the present invention provides an improved plastic bag packing system. As such, the general purpose of the present invention, which will be described subsequently in greater detail, is to provide a new and improved plastic bag packing system and method which has all the advantages of the prior art and none of the disadvantages.

To attain this, the present invention essentially comprises a new and improved plastic bag packing system comprising, in combination: a retail store check out counter having a generally rectangular shaped front section with an upper surface and a front wall, the front wall having a generally rectangular shaped recess extending therein, the recess having an open top, two side walls, a rear wall and a floor, the rear wall including a centrally positioned horizontal rod; an electrically powered motor including rotation means, a pinion gear being operatively coupled to the rotation means and extending from the motor, a wire electrically coupling the motor to an electrical source, a rack formed in an elongated configuration and including a plurality of grooves, the rack having a forward end and a rearward end, the rearward end of the rack being coupled to the pinion gear such that rotation of the pinion gear causes the rack to move rearward or forward upon engagement of the motor; a retractable arm assembly comprising two forwardly extending horizontal arms and a horizontal rear bar, the approximate center point of the rear bar being coupled to the forward end of the rack, the arms being slidably positioned through the rear wall of the recess in the check out counter, the forward end of each arm including an upturned knob, each arm having an upper surface including a rubber heel affixed adjacent to the upturned knob thereof, each rubber heel having a rear end elevated a short distance from the upper surface of the arm in an angled orientation; a foot pedal formed in a planar rectangular configuration with rounded edges, the foot pedal having a lower surface including non-slip ridges and adapted to be positioned on the ground, the foot pedal being operatively coupled to the motor by an electrical cord, depression of the foot pedal activating the motor to retract and extend the arms of the apparatus; and a plurality of T-shirt plastic bags formed in a generally rectangular configuration with a front panel, a rear panel, two side panels and a floor, the front and rear panels each having an upper extent including a handle extending therefrom, the bags being collapsible and including side members with apertures extending therethrough, the bags adapted to be suspended from the apparatus with the handle being positioned upon the rod and the apertures of the side members positioned upon the arms, in an operative orientation a user depressing the foot pedal thereby retracting the arms toward the bags whereby the rubber heel grabs the front panel of a single plastic bag and extends it in a forward direction so that the bag becomes positioned in an open orientation, packing of plastic bags being facilitated by hands free operation of the apparatus.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved plastic bag packing system which has all of the advantages of the prior art plastic bag holders and none of the disadvantages.

It is another object of the present invention to provide a new and improved plastic bag packing system which may be easily and efficiently manufactured and marketed.

It is further object of the present invention to provide a new and improved plastic bag packing system which is of durable and reliable constructions.

An even further object of the present invention is to provide a new and improved plastic bag packing system which is susceptible of a low cost of manufacture with regard to both materials and labor, and which accordingly is then susceptible of low prices of sale to the consuming public, thereby making such plastic bag packing system economically available to the buying public.

Still yet another object of the present invention is to provide a new and improved plastic bag packing system which provides in the apparatuses and methods of the prior art some of the advantages thereof, while simultaneously overcoming some of the disadvantages normally associated therewith.

Still another object of the present invention is suspending plastic bags in an open orientation by activating the foot pedal of the apparatus.

Lastly, it is an object of the present invention to provide a new and improved a plastic bag packing system adapted for use in association with a retail store check out counter having a generally rectangular shaped front section with a front wall, the front wall having a generally rectangular shaped recess extending therein, the recess having a rear wall including a centrally positioned horizontal rod, the apparatus comprising: an electrically powered motor including a rotation device, a pinion gear being operatively coupled to the rotation means and extending from the motor, a plurality of wires electrically coupling the motor to an electrical source and an activation device, a rack formed in an elongated configuration and including a plurality of grooves, the rack having a forward end and a rearward end coupled to the pinion gear such that rotation of the pinion gear causes the rack to move rearward or forward upon engagement of the motor; and a retractable arm assembly comprising two forwardly extending horizontal arms and a horizontal rear bar, the rear bar being coupled to the forward end of the rack, the arms being slidably positioned through the rear wall of the recess in the check out counter, the forward end of each arm including an upturned knob, each arm having an upper surface including a rubber heel affixed adjacent to the upturned knob thereof, each rubber heel having a rear end elevated a short distance from the upper surface of the arm in an angled orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
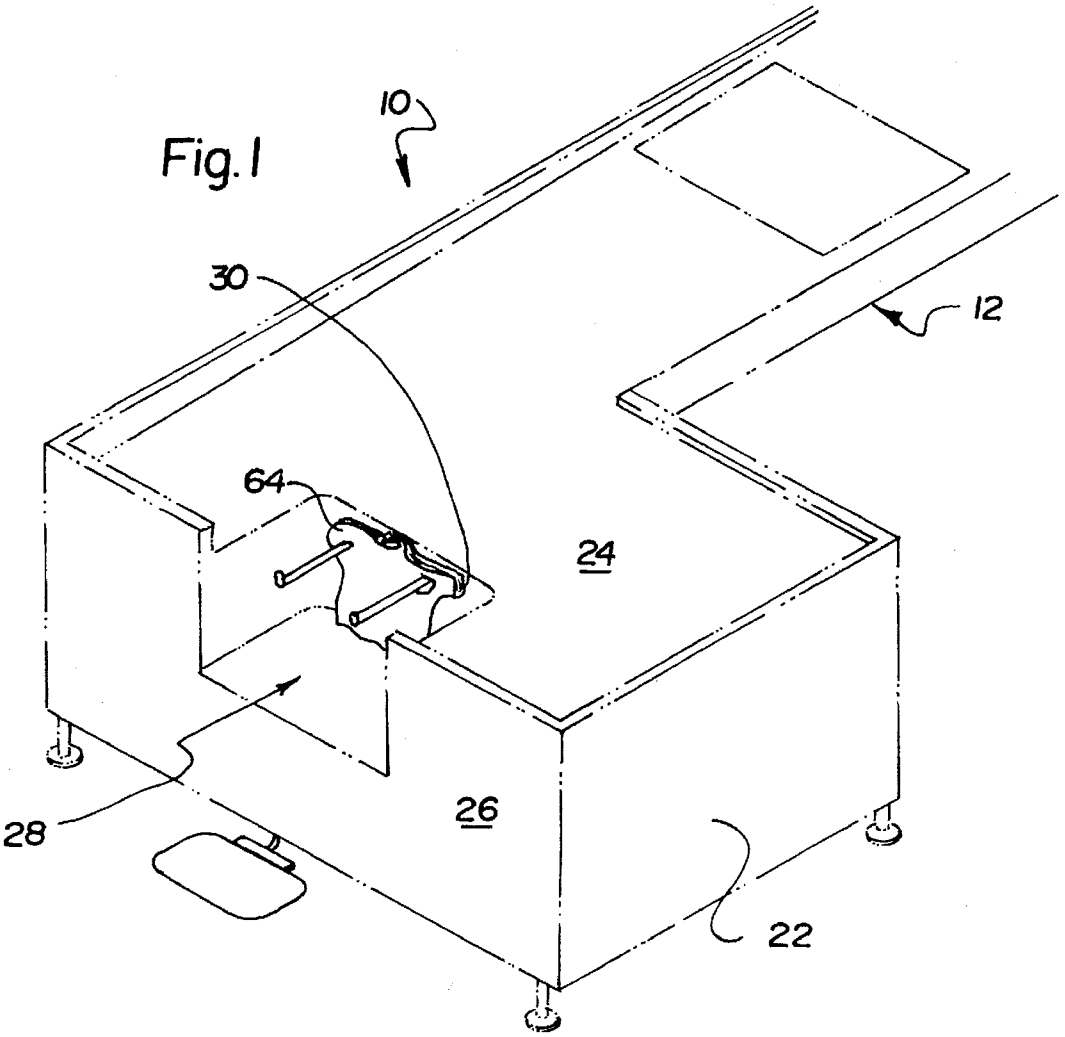
FIG. 1 is a perspective view of the preferred embodiment of the plastic bag packing system constructed in accordance with the principles of the present invention.

With reference now to the drawings, and in particular to FIG. 1 thereof, the preferred embodiment of the new and improved plastic bag packing system embodying the principles and concepts of the present invention and generally designated by the reference numeral 10 will be described.

The present invention, the plastic bag packing system 10 is comprised of a plurality of components. Such components in their broadest context include a check out counter 12, a motor 14, a retractable arm assembly 16, a foot pedal 18 and plastic bags 60. Such components are individually configured and correlated with respect to each other so as to attain the desired objective.

More specifically, the retail store check out counter 12 has an elongated aisle section which includes a scanner. The check out counter also includes a generally rectangular shaped front section 22 with an upper surface 24 and a front wall 26. Items are placed on the aisle section of the counter by customers and slid over the scanning device by the store cashier. Items are then pushed to the front section of the counter in preparation for bagging. Note FIG. 1.

Figure 5:
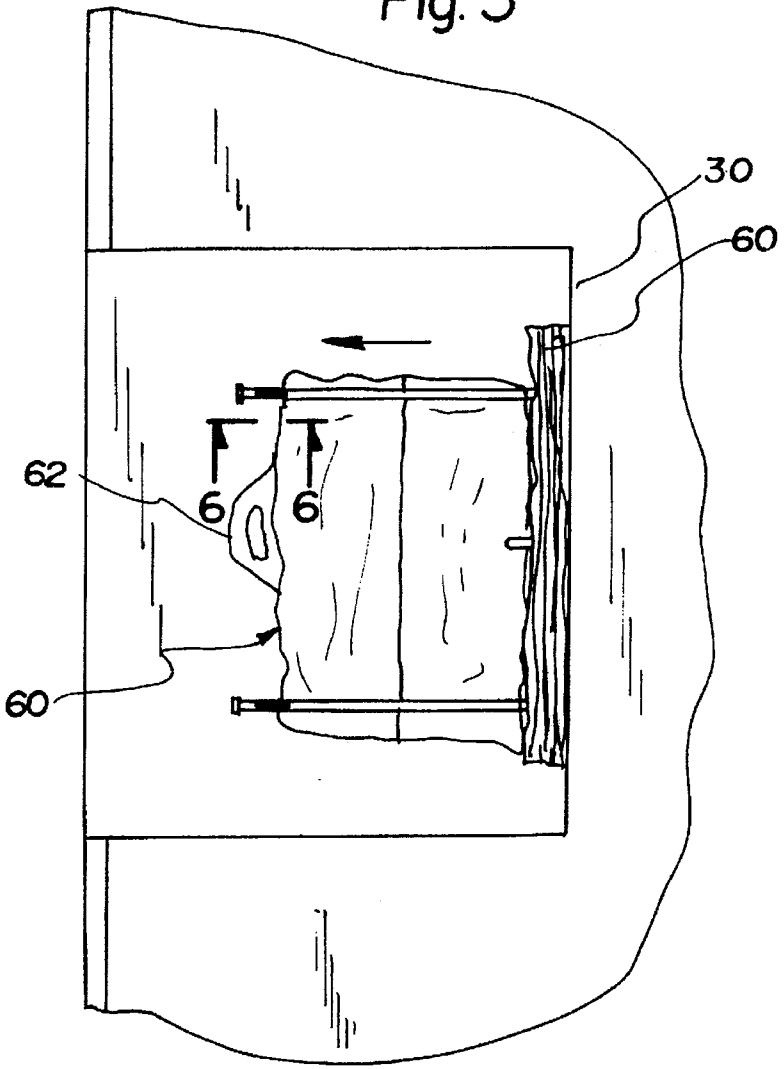
FIG. 5 is a top perspective view of the retractable arm assembly positioned in an extended orientation with a bag suspended between the arms.

The front wall of the front section of the counter has a generally rectangular shaped recess 28 extending within it. The recess has an open top, two side walls, a rear wall 30 and a floor. The rear wall includes a centrally positioned horizontal rod 32 extending frontwardly from it adjacent to the upper surface of the counter. In an operative orientation the handles 62 of the plastic bags 60 are suspended from the horizontal rod 32. Note FIGS. 1 and 5.

Figure 3:
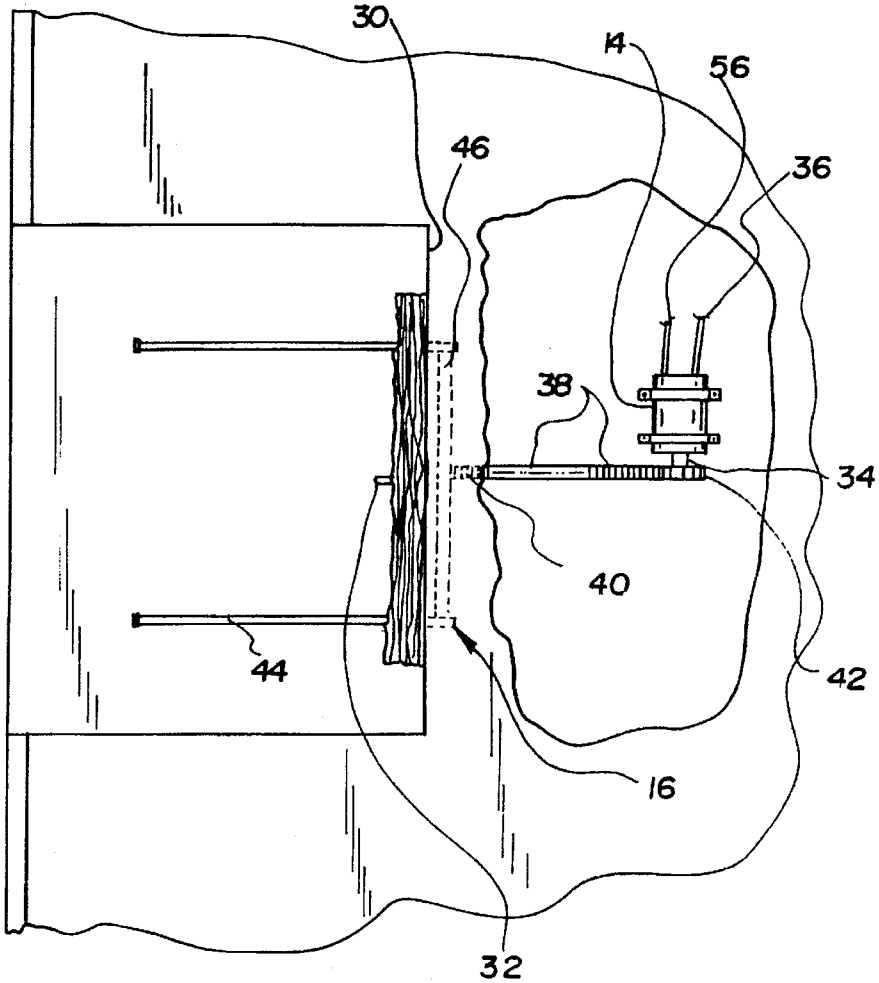
FIG. 3 is a partially broken away top perspective view of the motor and retractable arm assembly of the apparatus.

An electrically powered motor 14 is included with the apparatus. The motor includes rotation means which is activated upon electrical engagement of the motor. A pinion gear 34 is operatively coupled to the rotation means and extends from the motor. The pinion gear includes a plurality of gear teeth around its periphery. A wire 36 electrically couples the motor to an electrical source. In the preferred embodiment the electrical source is a conventional 120 volt AC outlet. In alternative embodiments the motor is powered by a portable DC power supply. The pinion gear rotates upon engagement of the motor. Note FIG. 3.

A rack 38 is formed in an elongated configuration and includes a plurality of grooves. The rack has a forward end 40 and a rearward end 42. The forward end is coupled to the rear bar of the retractable arm assembly of the apparatus. The rearward end of the rack is coupled to the pinion gear such that the gear teeth are coupled within the grooves of the rack. Upon initial activation of the motor the pinion gear rotates in a clockwise direction causing the gear teeth to mesh with the grooves along the rack. This action causes the rack to move rearwardly. When the arms of the retractable arm assembly move to the maximum rearward position, the rubber heels of the arms engage the plastic bags and the pinion gear then rotates in a counter clockwise direction. This action causes the arms to return to the fully extended orientation. Note FIG. 5.

Figure 4:
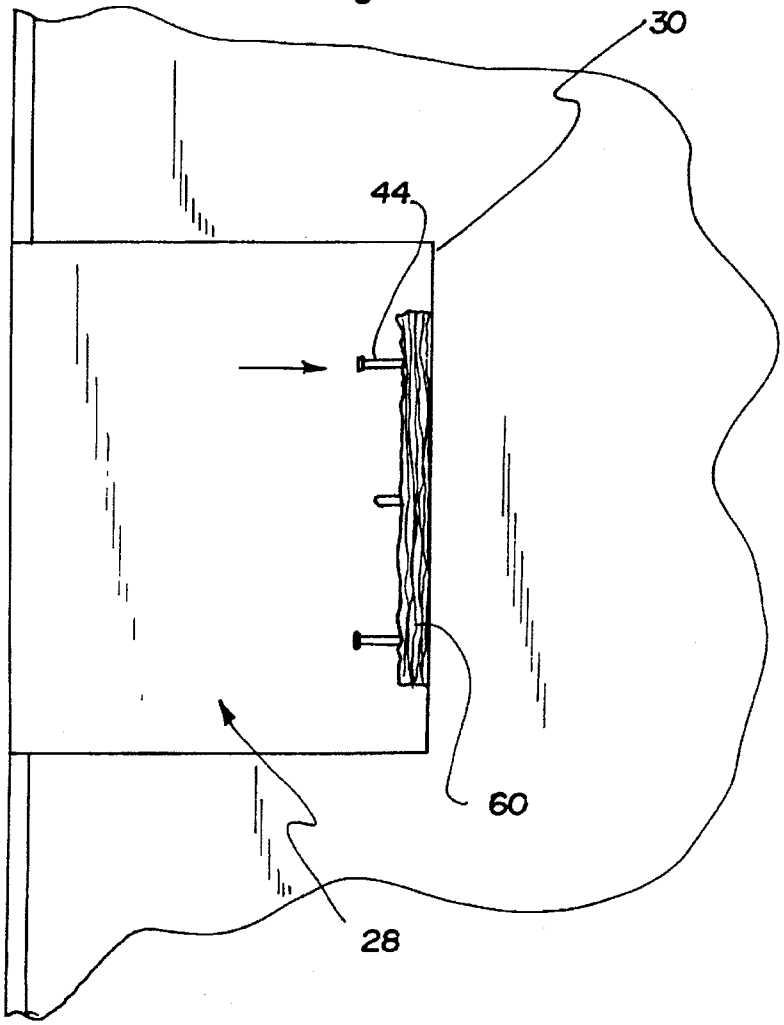
FIG. 4 is a top perspective view of the retractable arm assembly positioned in a retracted orientation.

The retractable arm assembly 16 comprises two forwardly extending horizontal arms 44 and a horizontal rear bar 46. The approximate center point of the rear bar is coupled to the forward end 40 of the rack. The arms are slidably positioned through the rear wall of the recess in the check out counter. The arms are positioned slightly below and to either side of the rod 32 of the apparatus. The forward end of each arm includes an upturned knob 48. The upturned knob functions to prevent plastic bags from slipping off of the arms. Note FIGS. 4 and 5.

Figure 6:
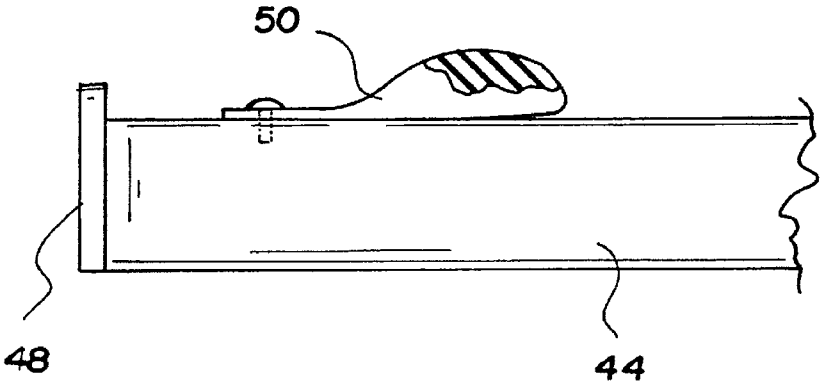
FIG. 6 is a sectional view of a retractable arm taken along section line 6—6 of FIG. 5 illustrating the configuration of a rubber heel of the apparatus.

Each arm has an upper surface which includes a rubber heel 50 affixed adjacent to the upturned knob. Each rubber heel is formed in a rounded configuration and has a rear end 52 which is elevated a short distance from the upper surface of the arm in an angled orientation. When the motor is engaged the arms retract toward the plastic bags and the heels snare the front panel of an individual bag. When the arms return to the fully extended orientation the bag becomes secured in an opened upright position. The bag is then easily packed by the store cashier, clerk or customer. Note FIG. 4–6.

Figure 2:
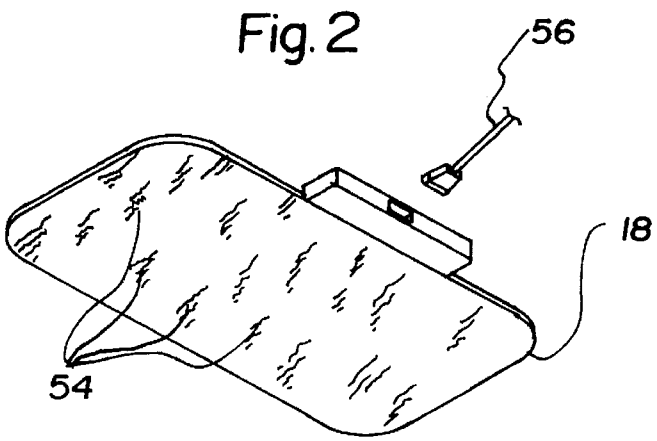
FIG. 2 is an isolated bottom perspective view of the foot pedal of the apparatus.

A foot pedal 18 is formed in a planar rectangular configuration with rounded edges. The foot pedal has a lower surface including non-slip ridges 54. The foot pedal is positioned on the floor in front of the recess of the check out counter. The foot pedal is operatively coupled to the motor by an electrical cord 56. Depression of the foot pedal activates the motor to retract and extend the arms of the apparatus thereby snaring and opening a plastic bag to be packed. Note FIGS. 2, 3 and 5.

A plurality of T-shirt plastic bags 60 are formed in a generally rectangular configuration with a front panel, a rear panel, two side panels and a floor. The front and rear panels each have an upper extent which includes a handle 62 extending from it. The bags are collapsible and include side members 64 with apertures extending through them. The bags are adapted to be suspended from the apparatus with the handle positioned upon the rod and the apertures of the side members positioned upon the arms. In an operative orientation a user depresses the foot pedal thereby retracting the arms toward the bags whereby the rubber heel grabs the front panel of a single plastic bag and extends it in a forward direction so that the bag becomes positioned in an open orientation. Packing of plastic bags is facilitated by the hands free operation permitted by the foot pedal. Note FIGS. 1 and 5.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved plastic bag packing system comprising, in combination:

a retail store check out counter having a generally rectangular shaped front section with an upper surface and a front wall, the front wall having a generally rectangular shaped recess extending therein, the recess having an open top, two side walls, a rear wall and a floor, the rear wall including a centrally positioned horizontal rod;

an electrically powered motor including rotation means, a pinion gear being operatively coupled to the rotation means and extending from the motor, a wire electrically coupling the motor to an electrical source, a rack formed in an elongated configuration and including a plurality of grooves, the rack having a forward end and a rearward end, the rearward end of the rack being coupled to the pinion gear such that rotation of the pinion gear causes the rack to move rearward or forward upon engagement of the motor;

a retractable arm assembly comprising two forwardly extending horizontal arms and a horizontal rear bar, the approximate center point of the rear bar being coupled to the forward end of the rack, the arms being slidably positioned through the rear wall of the recess in the check out counter, the forward end of each arm including an upturned knob, each arm having an upper surface including a rubber heel affixed adjacent to the upturned knob thereof, each rubber heel having a rear end elevated a short distance from the upper surface of the arm in an angled orientation;

a foot pedal formed in a planar rectangular configuration with rounded edges, the foot pedal having a lower surface including non-slip ridges and adapted to be positioned on the ground, the foot pedal being operatively coupled to the motor by an electrical cord, depression of the foot pedal activating the motor to retract and extend the arms of the apparatus; and a plurality of T-shirt plastic bags formed in a generally rectangular configuration with a front panel, a rear panel, two side panels and a floor, the front and rear panels each having an upper extent including a handle extending therefrom, the bags being collapsible and including side members with apertures extending therethrough, the bags adapted to be suspended from the apparatus with the handle being positioned upon the rod and the apertures of the side members positioned upon the arms, in an operative orientation a user depressing the foot pedal thereby retracting the arms toward the bags whereby the rubber heel grabs the front panel of a single plastic bag and extends it in a forward direction so that the bag becomes positioned in an open orientation, packing of plastic bags being facilitated by hands free operation of the apparatus.

2. A plastic bag packing system adapted for use in association with a retail store check out counter having a generally rectangular shaped front section with a front wall, the front wall having a generally rectangular shaped recess extending therein, the recess having a rear wall including a centrally positioned horizontal rod, the apparatus comprising:

an electrically powered motor including a rotation device, a pinion gear being operatively coupled to the rotation means and extending from the motor, a plurality of wires electrically coupling the motor to an electrical source and an activation device, a rack formed in an elongated configuration and including a plurality of grooves, the rack having a forward end and a rearward end coupled to the pinion gear such that rotation of the pinion gear causes the rack to move rearward or forward upon engagement of the motor; and a retractable arm assembly comprising two forwardly extending horizontal arms and a horizontal rear bar, the rear bar being coupled to the forward end of the rack, the arms being slidably positioned through the rear wall of the recess in the check out counter, the forward end of each arm including an upturned knob, each arm having an upper surface including a rubber heel affixed adjacent to the upturned knob thereof, each rubber heel having a rear end elevated a short distance from the upper surface of the arm in an angled orientation.

3. The apparatus as set forth in claim 2 wherein the activation device for the motor is a foot pedal formed in a planar rectangular configuration with rounded edges, the foot pedal having a lower surface including non-slip ridges and adapted to be positioned on the ground, the foot pedal being operatively coupled to the motor by an electrical cord, depression of the foot pedal activating the motor to retract and extend the arms of the apparatus.

4. The apparatus as set forth in claim 3 and further including:

a plurality of T-shirt plastic bags formed in a generally rectangular configuration with a front panel, a rear panel, two side panels and a floor, the front and rear panels each having an upper extent including a handle extending therefrom, the bags being collapsible and including side members with apertures extending therethrough, the bags adapted to be suspended from the apparatus with the handle being positioned upon the rod and the apertures of the side members positioned upon the arms, in an operative orientation a user depressing the foot pedal thereby retracting the arms toward the bags whereby the rubber heel grabs the front panel of a single plastic bag and extends it in a forward direction so that the bag becomes positioned in an open orientation, packing of plastic bags being facilitated by hands free operation of the apparatus.

* * * * *